US005417321A

United States Patent [19]

Halm

[11] Patent Number: 5,417,321

[45] Date of Patent: May 23, 1995

[54] TWO-COMPARTMENT CONTAINER

[75] Inventor: Hans Halm, Herne, Germany

[73] Assignee: Goldwell AG, Darmstadt, Germany

[21] Appl. No.: 279,449

[22] Filed: Jul. 25, 1994

[30] Foreign Application Priority Data

Aug. 4, 1993 [DE] Germany ..... 43 26 152.3

[51] Int. Cl.[6] ..... B65D 25/08

[52] U.S. Cl. ..... 206/221; 215/DIG. 8

[58] Field of Search ..... 206/219, 221; 215/DIG. 8

[56] References Cited

U.S. PATENT DOCUMENTS 4,331,233 5/1982 Braymer, Jr. ..... 206/221
4,727,985 3/1988 McNeirney et al. ..... 206/221
4,903,828 2/1990 Finke et al. ..... 206/221

*Primary Examiner*—Jacob K. Ackun

[57] ABSTRACT

This invention relates to an operationally reliable two-compartment container designed to prevent unintended use before application. The invention comprises a one-piece container having two compartments assembled one upon another, which are interlinked by a transfer opening into which a stopper is mounted to keep the contents of the two compartments separate during storage. The stopper is linked by supporting devices to the lower end of a pouring spout which seals the upper part of the container with a covering cap. The pouring spout is connected as a one-piece unit to an elastic membrane, which is turned inside of the container when closed, and outside when the container is opened, by which the pouring spout extends with an encompassing sealing cap into the collar region of the upper part of the compartment, is linked by a screw thread. The sealing cap is fitted with a safeguard against rotation at its junction point to the upper compartment to prevent premature removal of the covering cap, prior to admixture of the contents of the two compartments. The sealing cap includes a serration on the inside of the rim encompassing the covering cap under the sealing cap, and at least one corresponding cross-bar at the covering cap.

4 Claims, 5 Drawing Sheets

A-A

B-B

C-C

X

TWO-COMPARTMENT CONTAINER

BACKGROUND OF THE INVENTION

1. Field of the Invention

This invention comprises a new two-compartment container having a simplified construction and improved protection against misuse or unintended use in comparison to known two-compartment packages.

Two-compartment containers which are preferably designated for packaging cosmetic preparations containing ingredients, which must be kept separate until application because otherwise they would react with each other, are already known in a variety of embodiments.

2. The Prior Art

Reference is made, for example, to the two-compartment container according to German Patent Application No. 35 28 525 comprising two separately fillable chambers which are assembled upon another and parted from each other by a separating element forming at least part of the bottom wall of the upper compartment while sealing the lower compartment, whereof the separating element may be opened by a tappet actuating element operated from outside allowing the components to adjoin and mix, whereby the separating element is constructed as a separating stopper fitting tightly in a canal opening between the upper and the lower chamber, thus allowing vertical movement of the enclosing tappet actuating element from the passage opening into one of the chambers. A further development of such a two compartment container represents the container described in German Patent Application No. 38 12 343, wherein the passage opening between the compartments assembled upon another is closed by a separating stopper connected to a tappet actuating element which is formed as an elongated hollow application nozzle reaching through the upper container compartment to its open mouthpiece, whereby the tappet actuating element, on its outside, is fitted with an external thread gearing into the complementary internal thread of a sealing cap fitted in the front wall, partly including a cylindrical ring-shaped projecting part, fitted turnable on the same and sealing the compartment from the front end and at its open upper side. When turning the sealing cap in the sense of a screw-in motion of the application nozzle into this ring-shaped projecting part, the free end of the application nozzle can be pushed through the front opening.

German Patent Application No. 36 11 925 discloses a waist-shaped bottle with a stopper placed in the waisted part of the bottle to divide the bottle in two separate compartments, which are connectible by pressing the stopper from the waisted level into the compartment opposite the bottle closure, constructed so that both compartments have a relatively big volume to allow different filling proportions for the mixing ratio, but wherein the components to be admixed are safely combined. This is realized by the fact that a bar connection is made between the stopper and the bottle closure attached to the screw thread so that the sealing cap has an impact collar supported by the front end of the connecting bar.

All these two-compartment containers, as described, are suitable packaging systems, being in practical use. However, their construction is relatively complicated as they consist of many single components making production and packaging rather expensive.

SUMMARY OF THE INVENTION

The present invention, therefore, starts with the problem of developing a two-compartment container having a separating stopper for sealing two single compartments which are stacked upon another and kept separate until application; production and packaging of this container should be simple, it should have few single components but still allow safe separation of the products to be kept apart until application, and in the event of usage, allow reliable mixing of the components and discharge of the mixture.

It shall particularly be prevented that the contents of the upper compartment emerges unintended by accidental removal of the sealing cap.

According to the invention, this problem is solved by a two-compartment container being moulded as a one-piece part consisting of an upper and a lower compartment, these being separated by a stopper fitted at the junction point according to the features described below.

DETAILED DESCRIPTION OF THE PREFERRED EMBODIMENTS

Figure 1:
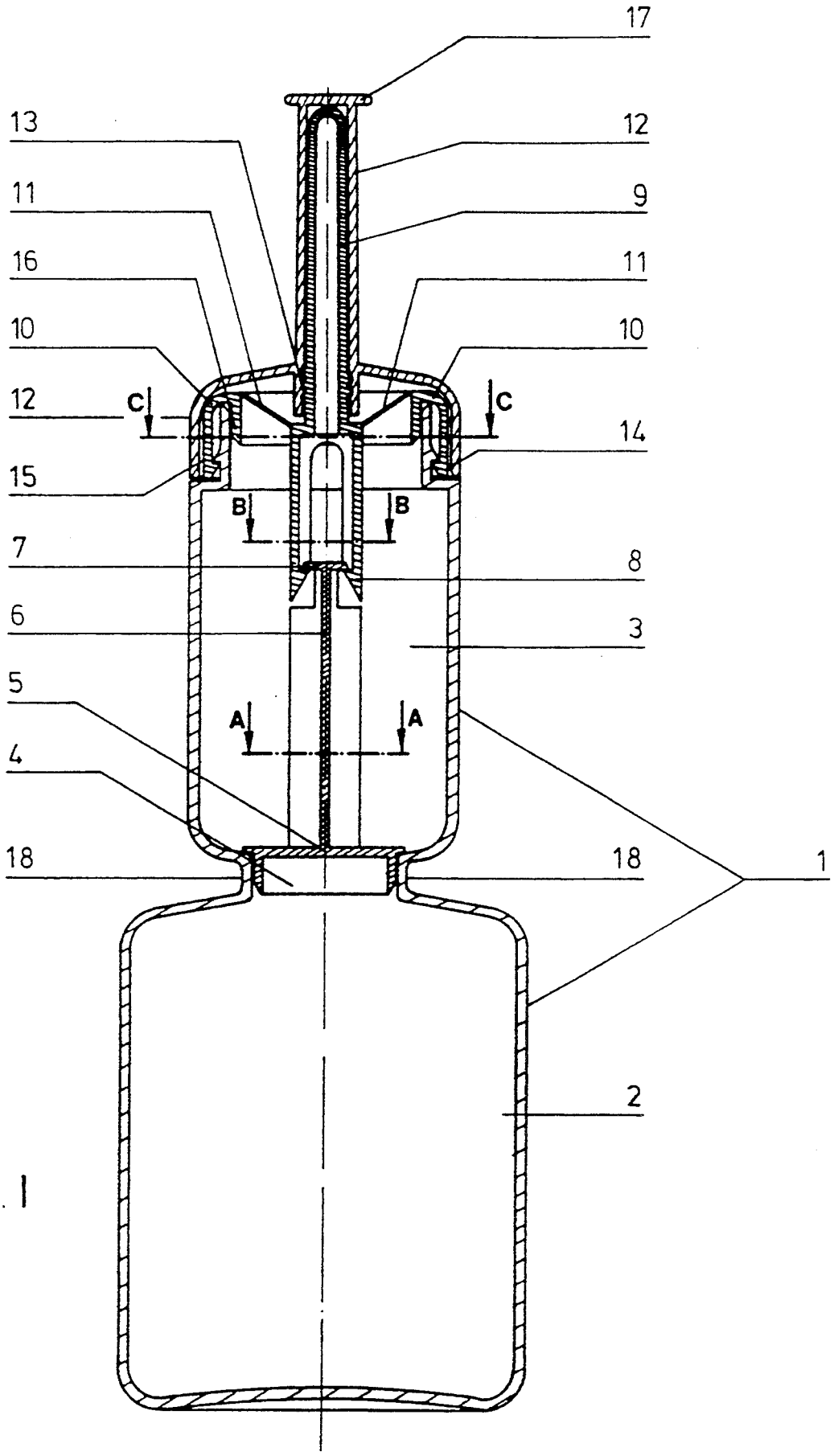
FIG. 1 illustrates a cross-sectional view of one embodiment in accordance with the present invention.
Figure 2:
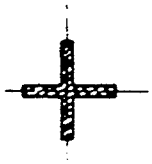
FIG. 2 illustrates a vertical section viewed along the line A—A in FIG. 1.
Figure 3:
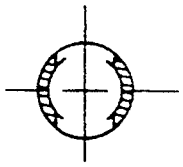
FIG. 3 illustrates the section along the line B—B in FIG. 1.
Figure 4:
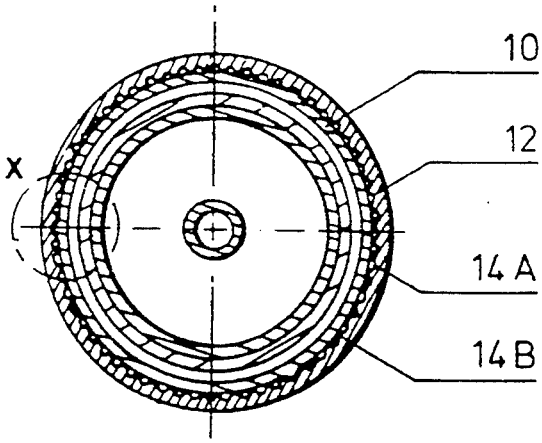
FIG. 4 illustrates the section along the line C—C in FIG. 1.
Figure 5:
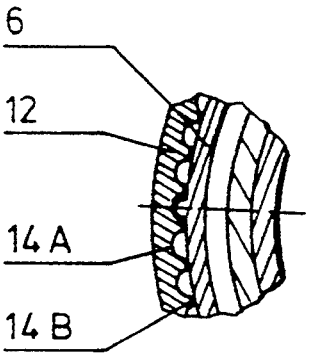
FIG. 5 is an expanded, detailed view of the X designated section of FIG. 4.
Figure 6:
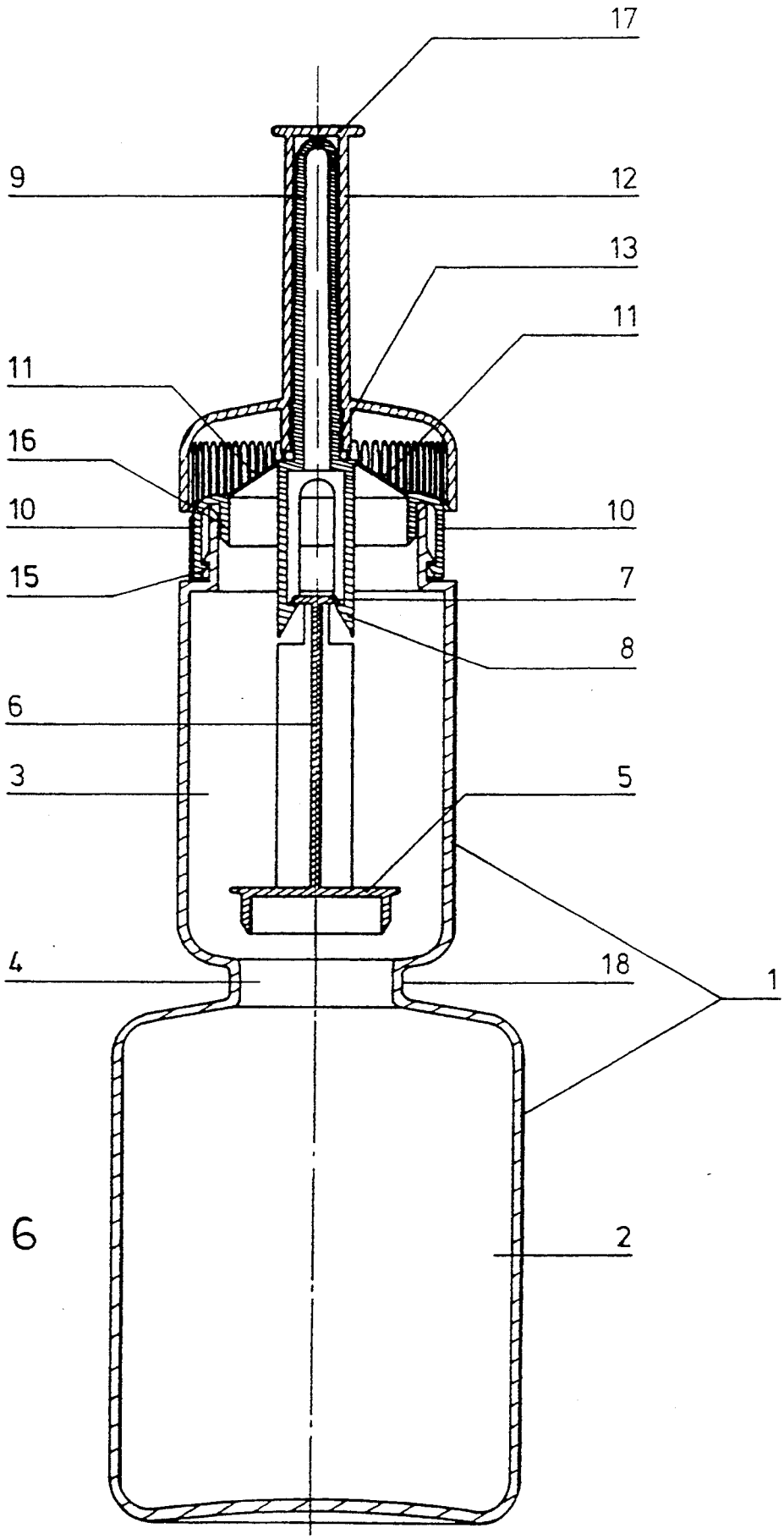
FIG. 6 illustrates the embodiment of FIG. 1 as "opened"
Figure 7:
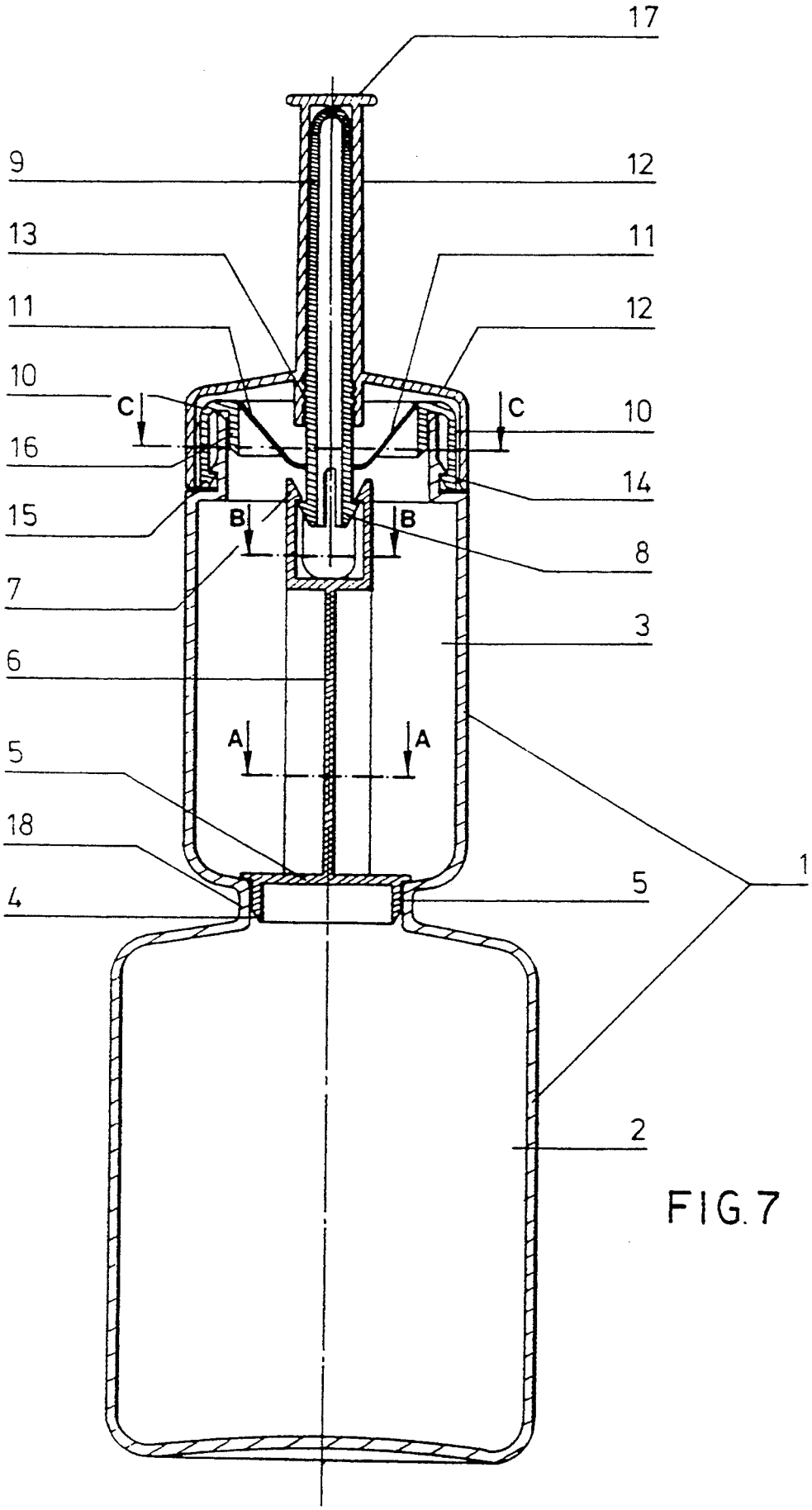
FIG. 7 illustrates a cross-sectional view of an equivalent embodiment to FIG. 1.

Referring now to the figures which illustrate the package according to the invention, FIG. 1 shows an example of the package when closed, FIG. 6 shows the same when opened. FIG. 2 shows a vertical section along the line A—A in FIG. 1, FIG. 3 shows the section along the line B—B, and FIG. 4 shows the section along the line C—C; FIG. 5 gives the detail X of FIG. 4; FIG. 7 relates to an equivalent section of FIG. 1.

In detail, the two-compartment container (1), moulded in one piece which is preferably blow-moulded, comprises two compartments (2) and (3) assembled upon another which are connected by a passage opening (4), preferably having a reduced diameter compared with the total circumference of the container. This passage opening is sealed by a stopper (5) joined to a coupling link (6) reaching into the upper compartment (3) and having on its end a disc-shaped or rectangular part (7).

Below this part (7) two claw-like or hook-shaped devices (8) lock in, forming the lower end of a pouring spout (9) which closes the upper compartment (3) with a covering cap (10) which, in turn, is connected in one piece to an elastic membrane (11) being turned toward the container when closed. This pouring spout (9), which has a dispenser opening at its upper end, reaches into the upper part of the container (3) by an encircling sealing cap (12), and is connected with the same by a screw thread (13).

The sealing cap (12) is fitted with a safeguard against rotation (14) at its junction point toward the upper container part (3) to prevent premature removal of the sealing cap (12) before mixing the contents of containers (2) and (3), which consists of a serration (14 A) on the inside of the rim of the sealing cap (12) encircling the covering cap (10) and at least one corresponding cross-bar (14 B) at the covering cap (10).

Due to the interlocking of the serration (14 A) and the crossbars (14 B) it is not possible to unscrew the sealing cap (12) before the contents of both compartments (2) and (3) are mixed.

FIG. 2 illustrates a section along the line A—A in FIG. 1 and shows the coupling link (6).

FIG. 3 shows a section along the line B—B in FIG. 1 and presents the lower end (8) of the pouring spout (9) which is preferably effected in the form of at least two claws or hooks which reach under the upper, preferably plate-like shaped end (7) of the coupling link (6), while spreading themselves and thereby forming an irreversible linkage with the upper end of the coupling link (6).

FIG. 4 shows the serration (14 A) in its connection to the cross-bars (14 B) according to section line C—C in FIG. 1. Hereby the covering cap (10) is firmly connected to the container wall by a snap-on linkage (15), preferably with an additional sealing lip (16) as shown in FIG. 1.

FIG. 5 again illustrates, in an enlarged and detailed version, the arrangement of the serration (14 A) and the cross-bars (14 B) according to the details of section X in FIG. 4.

FIG. 6 shows the two-compartment package in a ready-for-use, i.e., opened state.

The opening process takes place in two steps:

The sealing cap (12) is pulled up with the aid of a handle (17) fitted at its tip, thereby removing the stopper (5) from the passage opening (4), by the connection between lower end (8) of the pouring spout (9) and the coupling link (6), whereby the contents of the lower part of the container (2) is mixed with that of the upper part (3). Thereby the elastic membrane (11) is turned outside.

The movement of the sealing cap (12) eliminates the connection between the serration (14 A) and the cross-bars (14 B) at the covering cap (10). Thereby unscrewing of the sealing cap (12) becomes possible which was blocked in non-operated condition.

When turning the membrane (11) outside, the volume of the container (1) is necessarily enlarged, thus creating a vacuum.

On the other hand excess pressure may build up owing to gas formation ($CO_2$) by the reaction of the container contents. Therefore, an equilibrium should be adjusted by choosing appropriate quantities of the container contents to achieve pressure compensation.

However, it may be advantageous not to balance the built-up vacuum completely but to maintain a slight vacuum in the container.

This has the effect that the vacuum is only compensated by the stream of incoming air when the sealing cap (12) is unscrewed, whereby any liquid already escaped into the pouring spout (9) is sucked back into the container.

FIG. 7 shows an equivalent embodiment to FIG. 1, wherein the upper end (7) between coupling link (6) and the lower end (8) of the pouring spout (9) are formed as complementary hooks interlocking into each other.

Naturally, further equivalent embodiments of the invention are feasible.

Filling and packaging of the two-compartment container according to the invention are performed in a conceivably simple way:

First the lower part of the container (2) is filled with a solution, emulsion, dispersion, etc., then the passage opening (4) is closed by the stopper (5), the upper compartment (3) is filled; thereafter the sealing cap (12) affixed with its integrated parts, and the total container (1) is sealed.

Figure 8B:
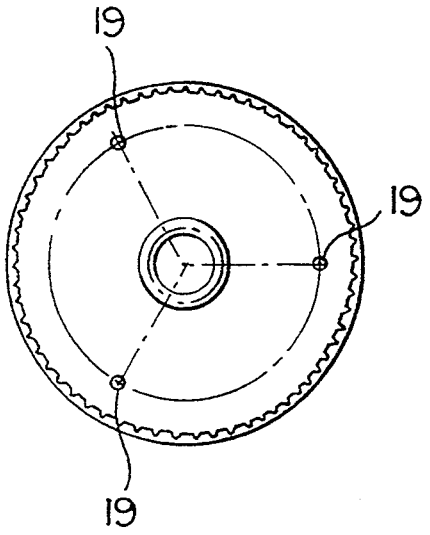
FIG. 8B is a top view of FIG. 8A.
Figure 8A:
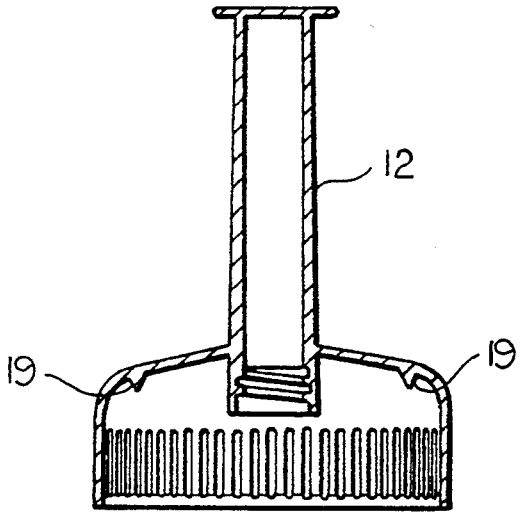
FIG. 8A illustrates a cross-sectional view of a preferred embodiment of a sealing cap.

A further preferred embodiment is illustrated by FIGS. 8A and 8B, where the sealing cap (12) is connected with the shoulder of the covering cap (10) through welding, e.g. ultrasonic welding, by means of corresponding welding cones (19) or points, resp.

FIG. 8A shows a section through the sealing cap (12); FIG. 8B a top view on the covering cap (10).

By the welding process the elastic membrane (11) and the lower end (8) of the pouring spout (9) are fixed with defined force, the stopper (5) is secured against unintended opening, e.g., by pressure developing in the lower compartment (2); and, finally, the welding connection forms an additional originality seal for the container.

The two-compartment container according to the invention may principally be used for packing any type of product comprising two compositions which must be kept separate until application, as they are intended to react with each other only just before or at the time of application.

The system according to the invention is preferably used in cosmetics, for instance hair cosmetics. Suitable products are preferably permanent waving compositions, e.g., so-called acidic permanent waving compositions on the basis of glycerol monothio-glycollate, which must be kept apart from the aqueous remainder of the total composition until application.

The elements of the two-compartment package according to the invention are preferably made from plastic material, e.g., polyethylene, polypropylene, polyester and polyamide.

The total container may be made from polyester-polyamide co-extrudate. The sealing cap with its integrated elastic membrane and the closing stopper are preferably made from polyethylene.

I do not limit myself to any particular details of constructions set forth in this specification and illustrated in the accompanying drawings, as the same refers to and sets forth only certain embodiments of the invention, and it is observed that the same may be modified without departing from the spirit and scope of the claimed invention.

Having thus described the invention, what is claimed as new and desire to be secured by Letters Patent is as follows:

I claim:

1. A two-compartment container moulded as a one-piece unit, comprising:

two compartments (2, 3), one compartment of said two compartments (2, 3) stacked on top of another compartment of said two compartments (2, 3) a passage opening (4) connecting said two compartments (2, 3), a stopper (5) for closing said passage opening (4) in order to keep the contents of said two compartments (2, 3) separate during storage; a coupling link having an upper end (7) for connecting said stopper (5) to a lower end (8) of a pouring spout (9), said pouring spout (9) being formed in one piece and connected to a covering cap (10) sealing the upper compartment (3), by an elastic membrane (11) which is turned inside, when the container is closed, and turned outside, when the container is opened; and the pouring spout (9) is joined with an encompassing sealing cap (12) extending to a collar region of an upper compartment (3) of said two compartments (2, 3), by a screw thread (13), whereof the sealing cap (12) is fitted at its junction point to the upper compartment (3) of the container (1) with a safeguard against rotation (14) to prevent premature removal of the sealing cap (12) prior to admixture of the contents of the compartments (2, 3), and includes a serration (14 A) on an inside of a rim of the sealing cap (12) which overlaps the covering cap (10), and at least one corresponding cross-bar (14 B) attached to the covering cap (10).

2. Two-compartment container according to claim 1, wherein said container has a total diameter and further comprising a section between the container parts (2, 3), containing the passage opening (4) which has a reduced diameter compared with the total diameter of the container (1).

3. Two-compartment container according to claim 1 wherein the sealing cap (12) is connected with the shoulder of the covering cap (10) through welding by means of welding cones or points (19).

4. Two-compartment container according to claim 2 wherein the sealing cap (12) is connected with the shoulder of the covering cap (10) through welding by means of welding cones or points (19).

* * * * *